US008389914B2

(12) United States Patent
Myoji

(10) Patent No.: US 8,389,914 B2
(45) Date of Patent: Mar. 5, 2013

(54) HEATING COOKER HAVING DRAWER TYPE AUTOMATIC DOOR

(75) Inventor: Toshiro Myoji, Kawachinagano (JP)

(73) Assignee: Sharp Kabushiki Kaisha, Osaka (JP)

( * ) Notice: Subject to any disclaimer, the term of this patent is extended or adjusted under 35 U.S.C. 154(b) by 1428 days.

(21) Appl. No.: 12/027,908

(22) Filed: Feb. 7, 2008

(65) Prior Publication Data

US 2009/0200297 A1 Aug. 13, 2009

(51) Int. Cl.
*H05B 6/64* (2006.01)

(52) U.S. Cl. ..... 219/702; 219/762; 700/275

(58) Field of Classification Search ..... 219/702, 219/756–758, 762–763, 403, 414, 390–392, 219/402, 752, 722; 126/339–340, 197, 192; 99/483; 700/275

See application file for complete search history.

(56) References Cited

U.S. PATENT DOCUMENTS

| | | | | |
|---|---|---|---|---|
| 4,309,585 | A * | 1/1982 | Doi et al. | 219/720 |
| 2006/0163239 | A1* | 7/2006 | Yoshidome et al. | 219/392 |
| 2008/0288113 | A1* | 11/2008 | Nishio | 700/275 |

FOREIGN PATENT DOCUMENTS

| | | | |
|---|---|---|---|
| JP | 3-45820 | A | 2/1991 |
| JP | 5-83614 | A | 11/1993 |
| JP | 11-237053 | A | 8/1999 |
| JP | 2002-162040 | A | 6/2002 |
| JP | 2003-247726 | A | 9/2003 |
| JP | 2005-201501 | A | 7/2005 |

* cited by examiner

*Primary Examiner* — Quang Van

(74) *Attorney, Agent, or Firm* — Birch, Stewart, Kolasch & Birch, LLP

(57) ABSTRACT

A cooking device having a drawer type automatic door in which delicate control is carried out when the door is opened and closed, whereby influence exerted on an object to be cooked by a shock produced at the time of door opening and closing can be reduced or eliminated. When a before-stop position (full opening detection switch Pso at the time of full opening, intermediate switch Psi at the time of full closing) provided before the stop position of the door is detected, the travel speed of a drawer body is controlled. A speed control is configured to reduce the speed of the drawer body in response to the arrival of the drawer body at a before-stop position and increase the closing speed of the drawer body in response to the arrival of the drawer body at a latch riding position.

15 Claims, 5 Drawing Sheets

HEATING COOKER HAVING DRAWER TYPE AUTOMATIC DOOR

The present application is based on Japanese patent application No. 2006-197244 filed on Jul. 19, 2006, the entire contents of which are hereby incorporated by reference.

BACKGROUND OF THE INVENTION

In the field of microwave oven, new distinct configuration of automatic drawer type is emerging of late, for which this invention is intended for a further improvement.

Up to now, the engineers in charge of drawer type microwave oven anticipated implementing practices of manual drawer operation.

To name an example, if the automatic operation of the drawer is allowed to stop flat and hard at the end of opening operation, it might jerk the soup plate or topple the beverage mug to cause spillage to the disappointment of the customer.

This invention is intended to minimize the disappointment in this respect.

FIELD OF THE INVENTION

The present invention relates to a cooking device having a drawer type automatic door, such as a microwave oven, provided with a drawer type heating space.

DESCRIPTION OF THE RELATED ART

Conventionally, a drawer type cooking device in which a drawer body on which an object to be heated can be placed can be drawn out of a cooking device body together with a door, and an opening part of a heating chamber can be closed by the door in the state in which the drawer body is accommodated in the heating chamber provided in the cooking device body has been proposed (Japanese Patent Laid-Open Publication No. 3-45820 (page 2, left lower column, line 6 to page 3, tight upper column, line 16, FIG. 1), Japanese Patent Laid-Open Publication No. 11-237053 (paragraph 0029-32, FIG. 1 to FIG. 5)). The drawer type cooking device of this type includes a device body (cooking device body) having a cooking chamber (heating chamber) for accommodating the object to be heated, a door for isolating the cooking chamber from the outside air, and a bottom plate moving in association with the door or a heating container (drawer body) in which an object to be cooked can be placed. More specifically, the bottom plate or the heating container is slid smoothly by a slide mechanism, and the rotational output of a motor is transmitted to the slide mechanism via transmitting means such as a rack-and-pinion mechanism, by which the bottom plate or the heating container can be moved in the draw-out or accommodation direction with respect to the device body. In the state in which the bottom plate or the heating container is accommodated in the device body, the door isolates the cooking chamber from the outside air. In the cooking device described in Japanese Patent Laid-Open Publication No. 11-237053 (paragraph 0029-32, FIG. 1), by covering the opening of the heating container, which is formed with the opening at the upper part thereof and can be drawn out of the cooking device body, with a lid part, the heating chamber that traps microwaves is formed, and by providing a choke groove between the peripheral edge part of the opening of the heating container and the lid part, the leakage of electric waves is prevented.

However, in the conventional cooking device having an automatic door, in the case where an object of the cooking is a liquid or a liquid object put in a cup or a soup put in a soup plate having a shallow depth, when the object is accommodated in the heating chamber or taken out of the heating chamber, if the door is opened or closed at a fixed speed, there is a possibility of falling of the cup or overflowing of the soup or the like.

When foods are heatedly cooked, the door must be opened and closed before and after heating. The door and a table part on which the object to be heated is placed form the integral drawer body, so that the inertia of the whole of the drawer body is great. This inertia depends greatly on the weight of the object to be cooked (object to be heated). Therefore, even in the case where the door is opened or closed automatically, when the door is stopped, a large force tends to be applied to the door. At this time, a positional error is produced in the position control, and also a great acceleration is produced on the object to be heated accommodated in the drawer body, so that the heating of foods is sometimes not performed normally: for example, the food may be brought down or caused to overflow by the shock.

Therefore, the cooking device having a drawer type automatic door has a problem to be solved in that the cooking device must be configured so that in order to restrain the degree of occurrence of shock that is liable to be produced on the object to be heated at the time of door opening and closing, especially at the time of door stopping, speed control can be carried out to reduce the stop speed of the drawer body when the movement of the drawer body is started or stopped.

SUMMARY OF THE INVENTION

An object of the present invention is to provide a cooking device having a drawer type automatic door in which delicate control is carried out when the door is opened and closed, whereby an influence (falling, overflowing, or the like) exerted on an object to be heated such as a food by a shock produced at the time of door opening and closing can be reduced or eliminated and noise generated at the time of shocking can be restrained.

To achieve the above object, the present invention provides a cooking device having a drawer type automatic door, including a cooking device body formed with a heating chamber therein; a drawer body which can be drawn out of and accommodated in the heating chamber and integrally has a door capable of closing the opening part of the heating chamber in the accommodated state; and driving means for driving the drawer body in the opening/closing direction, wherein the cooking device further includes specific position detecting means for detecting that the door has reached a before-stop position provided before the stop position of the door; and speed control means for controlling the speed of the drawer body using the driving means, the speed control means being configured to reduce the speed of the drawer body by the driving means in response to the detection of the before-stop position carried out by the specific position detecting means.

According to this cooking device having a drawer type automatic door, when the before-stop position provided before the stop position of the door is detected by the specific position detecting means, in response to the detection, the speed control means controls the driving means to reduce the travel speed of the drawer body. Therefore, for the door opening and closing at the time of start and finish of cooking, a position at which the drawer body is to be stopped automatically is recognized, and the opening/closing speed leading to the stopping can be controlled. For example, the speed of the drawer body begins to decrease at the before-stop position while the drawer moves toward the stop position, so that the sudden stop of the drawer body at the stop position is prevented, and the degree of shock at the time of stopping is restrained, by which the influence on the object to be cooked such as a food can be reduced or eliminated.

In this cooking device having a drawer type automatic door, the stop position is a fully opened position of the door, and at the before-stop position, a full opening detection switch detectable by the specific position detecting means can be provided. Also, the stop position is a fully closed position of the door, and at the before-stop position, an intermediate switch detectable by the specific position detecting means can be provided. In the normal usage mode of cooking device, the door most often assumes the fully opened position and the fully closed position as the stop position, so that it is realistic to control the speed of the drawer body (door) with respect to the fully opened position and the fully closed position.

In this cooking device having a drawer type automatic door, it is preferable that the speed control means increase the closing speed of the drawer body in response to the arrival of a latch head provided on the drawer body at a latch riding position at which the latch head begins to engage with a latch hook attached to the cooking device body at a position closer to the fully closed position than the before-stop position. According to this cooking device having a drawer type automatic door, in order to engage the latch head provided on the drawer body with the latch hook attached to the cooking device body, the drawer body requires momentum. Therefore, when the latch head arrives at the latch riding position, the closing speed of the drawer body is increased in response to the arrival, so that the latch hook can get over the latch with increasing momentum.

In this cooking device having a drawer type automatic door, the driving means is provided with counting means for outputting a count according to the displacement of the drawer body, and the displacement of the drawer body can be measured indirectly by the counting means. For example, in the case where the driving means is a motor, the rotational output thereof is usually converted to the displacement of the drawer body by a rack-and-pinion mechanism. In this case, the amount of output rotation of the motor corresponds to the displacement of the drawer body. If the amount of output rotation is counted by the counting means such as a rotary encoder, this counting means can function as position detecting means, and the detected count amount becomes a value for indirectly detecting the position of the drawer body. Such an indirect detection of the position of the drawer body enables delicate speed control, for example, in a relatively short section from the before-stop position to the complete stop.

In this cooking device having a drawer type automatic door, it is preferable that the speed control means can arbitrarily change the opening/closing speed of the door. By allowing the speed control means to arbitrarily change the opening/closing speed of the door, the opening/closing speed matching the user's liking can be set. Further, it is preferable that if an abnormality is detected when the door is opened or closed, in particular, stopped the abnormality detection be told to the user by using notifying means such as sound or display. The abnormality detection can be told to the user by using notifying means such as sound or display.

Since the cooking device having a drawer type automatic door in accordance with the present invention is configured as described above, in stopping the drawer body, the speed control is carried out from the before-stop position detected by the specific position detecting means. As a result, even if the weight of the drawer body is changed greatly, by carrying out delicate control before stopping, the influence (falling, overflowing, or the like) exerted on a food by a shock produced by stopping at the time of door opening and closing can be prevented and noise generated at the time of shocking can be restrained. Also, if an abnormality of speed of the drawer body occurs, the abnormality can be informed by means of display or sound. Further, the travel speed of the door from the before-stop position to the stop position can be controlled automatically, and moreover the speed at this time can be set at an arbitrary speed, so that the cooking device can be configured to specifications meeting the user's needs.

DETAILED DESCRIPTION OF THE PREFERRED EMBODIMENTS

Figure 1:
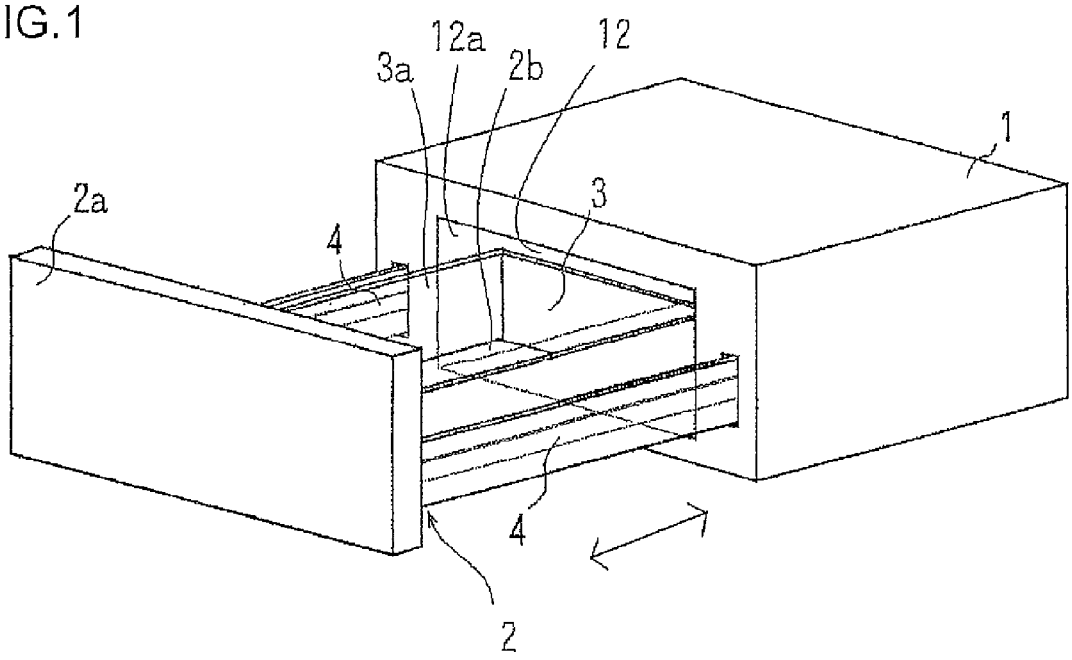
FIG. 1 is a perspective view of a drawer type cooking device.
Figure 2:
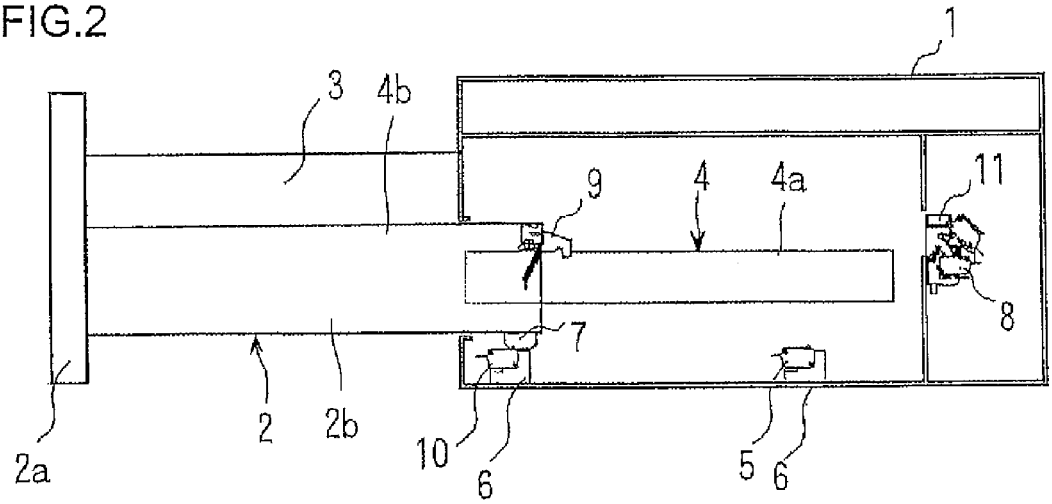
FIG. 2 is a side view of a drawer type cooking device, showing a state in which a door is fully opened.
Figure 3:
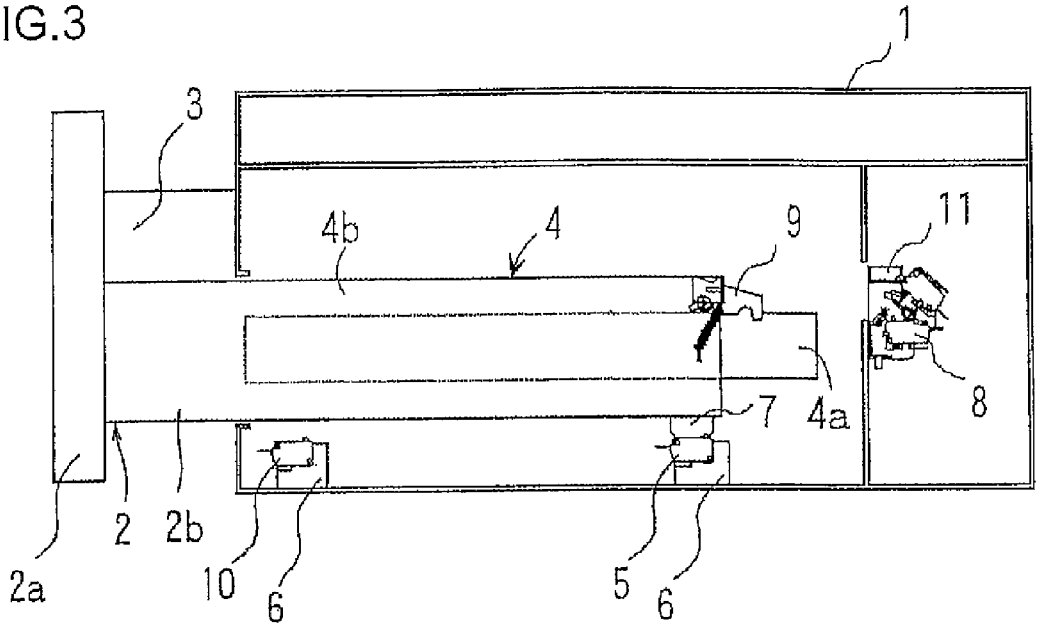
FIG. 3 is a side view of a drawer type cooking device, showing a state in which a door is at a deceleration position.
Figure 4:
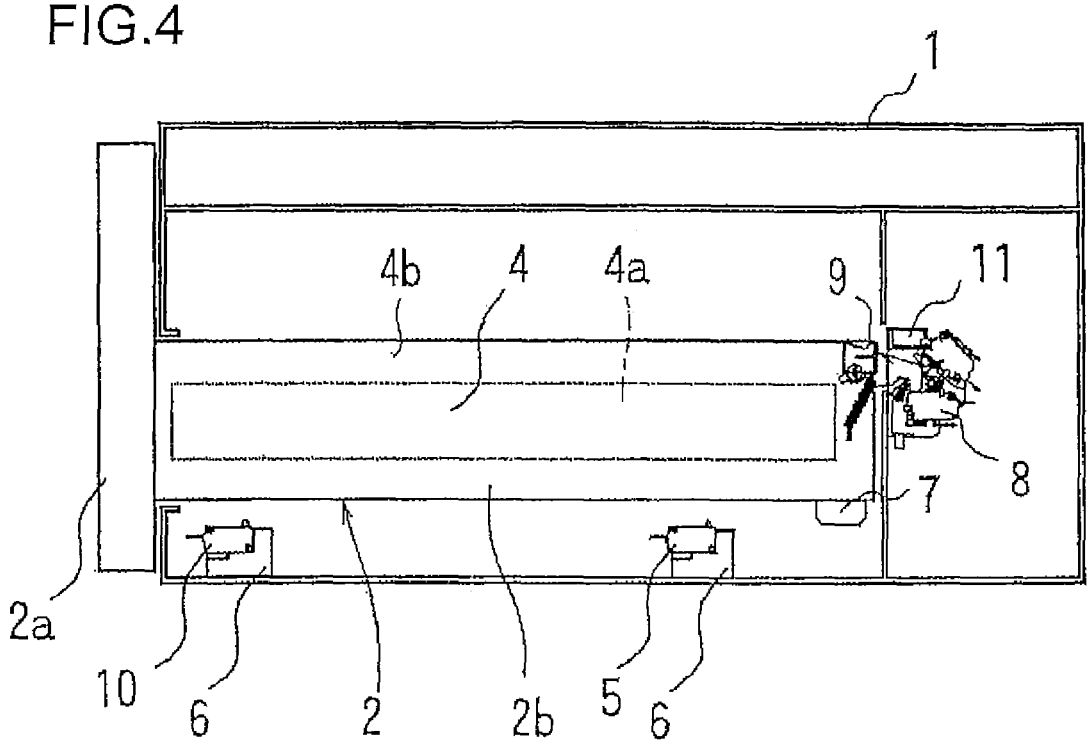
FIG. 4 is a side view of a drawer type cooking device, showing a state in which a door is fully closed.

An embodiment of a cooking device having a drawer type automatic door (hereinafter referred simply to as a "cooking device") in accordance with the present invention will now be described with reference to the accompanying drawings. FIG. 1 is a perspective view showing the outline of the cooking device in accordance with the present invention, showing a state in which the door is open. FIGS. 2 to 4 are side sectional views of the cooking device shown in FIG. 1, FIG. 2 showing a state in which the door is fully opened, FIG. 3 showing a state in which the door is at a deceleration position, and FIG. 4 showing a state in which the door is fully closed.

As shown in FIG. 1, the cooking device includes a cooking device body 1 and a drawer body 2 on which an object to be heated is placed together with an accommodation container for the object and which can be drawn out of and accommodated in the cooking device body 1. In the cooking device body 1, a heating chamber 12 in which the drawer body 2 can advance and retreat is formed. For the heating chamber 12, the interior thereof is surrounded by right and left, upper and lower, and back walls, but the front surface thereof is formed with an opening part 12*a* for the drawer body 2 to be drawn out and to be accommodated in.

The drawer body 2 is arranged so as to be movable with respect to the cooking device body 1 by means of a plurality of slide mechanisms 4, described later, so that the drawer body 2 can be drawn out of the heating chamber 12 of the cooking device body 1 to the outside in the direction indicated by the arrow mark or can inversely close the heating chamber 12 from the outside. The drawer body 2 includes a door 2*a* for opening and closing the heating chamber 12 and a table 2*b* to which the door 2*a* is attached and on which the object to be heated is placed. The table 2*b* and a space above the table 2*b* form a heating container 3 for accommodating the object to be heated and a container therefore. The heating container 3 has a front plate attached to the door 2*a*, right and left side plates extending to the rear from the right-hand and left-hand sides of the front plate, and a rear plate that connects the side plates to each other on the back surface side. These plates are attached to the table 2*b*. Also, in the upper part of the heating container 3, an opening part 3*a* that allows the object to be heated to be put in and taken out is formed. In the cooking device body 1, although not shown in the figures, a microwave generator configured by a magnetron for generating microwaves and a waveguide for propagating the microwaves generated by the magnetron is provided around the heating chamber 12. The microwaves generated by the magnetron propagate in the waveguide and are supplied to the interior of the heating chamber 12 through a feeding port.

The cooking device includes the slide mechanisms 4, 4 arranged at the right-hand and left-hand sides of the heating container 3 to move the drawer body 2 in the cooking device body 1. On the bottom side of the heating container 3 as well, a similar slide mechanism is arranged. In relation to the slide mechanism on the bottom side of the heating container 3, driving means, such as a motor, for putting and taking the drawer body 2 into and out of the heating chamber 12 and motion converting means, such as a rack-and-pinion mechanism, for converting the rotational output of the driving means into a linear motion are also provided additionally although these means are omitted in the figures. The drawer body 2 can be moved between a fully opened position at which the heating container 3 is completely drawn out of the heating chamber 12 and a fully closed position at which the heating container 3 is completely accommodated in the heating chamber 12. When the drawer body 2 is located at the fully closed position, the door 2*a* closes the opening part 12*a* of the heating chamber 12, so that the heating chamber 12 is hermetically sealed by the inner wall surfaces of the cooking device body 1 and the drawer body 2.

As shown in FIGS. 2 to 4, each of the slide mechanisms 4 consists of a telescopic slide rail that allows a movable rail 4*b* to slide on a fixed rail 4*a*. The slide mechanisms 4 are provided in passage boxes formed in the cooking device body 1 on the right-hand and left-hand sides and the bottom side of the heating chamber 12. The fixed rail 4*a* is attached to the outside of the heating chamber 12 in each passage box, and the movable rail 4*b* can be moved in each passage box together with the drawer body 2. The drawer body 2 is supported on the cooking device body 1 via the slide mechanisms 4, so that it can be drawn out of the heating chamber 12 stably.

One slide mechanism 4 is provided with means for operating a full closing detection switch 8 and a full opening detection switch 10 when the drawer body 2 is moved to the fully closed position and the fully opened position. For the full closing detection, when the drawer body 2 is pushed in from the open state to the fully closed position, an actuating lever (latch head) 9 provided at the farthest position of the movable rail 4*b* engages with a latch hook 11, whereby the full closing detection switch 8 is turned on. At a position slightly in front of the fully closed position (intermediate position), a before-position detection switch (intermediate switch) 5 is provided. The position of the intermediate switch 5 is set at a position at which the fingers or the hand of the user is likely to get caught by the door in the door closing operation. The full opening detection switch 10 and the intermediate switch 5 each are attached to the cooking device body 1 via a switch attaching angle 6.

In the farthest part of the movable rail 4*b*, there is provided an actuator 7 capable of operating the full opening detection switch 10 or the intermediate switch 5 when the actuator 7 reaches a position at which the full opening detection switch 10 or the intermediate switch 5 is provided. When getting out of the position of the switch, the actuator 7 turns off that switch. Therefore, when the drawer body 2 is located at the fully opened position, the actuator 7 operates the full opening detection switch 10 (FIG. 2), during the time when the drawer body 2 moves from the fully opened position to the fully closed position, when the actuator 7 reaches a position at which the intermediate switch 5 is provided, the actuator 7 operates the intermediate switch 5 (FIG. 3), and when the drawer body 2 is located at the fully closed position, the actuating lever 9 engages with the latch hook 11, thereby operating the full closing detection switch 8 (FIG. 4). Thus, by the operation of the detection switches 10, 5 and 8 arranged according to the fully opened position, the intermediate position, and the fully closed position of the drawer body 2, the position of the drawer body 2 (that is, the door 2*a*) can be detected. In the passage box, the further detailed draw-out positions of the drawer body 2 can be detected by arranging a plurality of detection switches in addition to the positions at which the full opening detection switch 10, the intermediate switch 5, and the full closing detection switch 8 are arranged.

When the drawer body 2 is drawn out, the actuating lever 9 is disengaged from the latch hook 11, by which the full closing detection switch 8 is turned off. Therefore, not only after the cooking but also during the cooking, if the drawer body 2 is opened, the supply of power to the microwave generator becomes in an off state, which makes the generation of microwaves disable. The full closing detection switch 8 can be used as a part of a switch for controlling the emission and stop of microwaves. The method for actually operating the cooking device can be set by the user's operation of other control switches. On the cooking device body 1 (or the door 2*a*), control switches for controlling the cooking device including a main switch for starting the cooking and a control switch for opening and closing the door 2*a* can be arranged.

Thus, the cooking device is configured as a drawer type cooking device in which the drawer body 2 on which the object to be heated can be placed can be drawn out of the cooking device body 1 together with the door 2*a*, and in the state in which the drawer body 2 is accommodated in the heating chamber 12 in the cooking device body 1, the opening part 12*a* of the heating chamber 12 can be closed by the door 2*a*.

Figure 5:
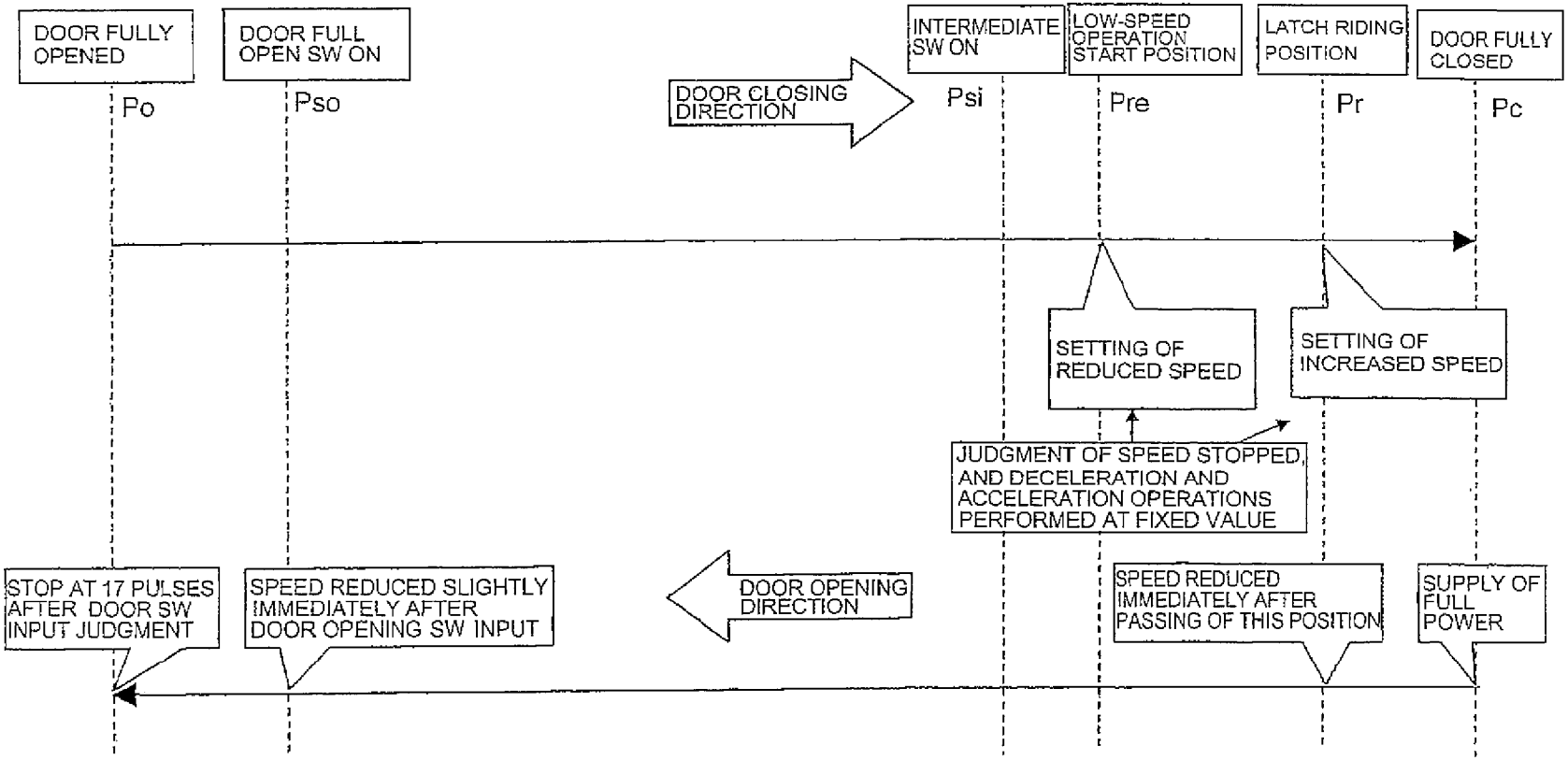
FIG. 5 is a chart showing a detailed example of opening/closing control including the control of speed of a door in a drawer type cooking device.

FIG. 5 is a chart showing a detailed example of opening/closing control including the control of speed of the door 2*a*. At the start of the opening/closing control of the door 2*a*, it is assumed that the door 2*a* is located at a fully closed position Pc. The operation of the door 2*a* is started in the door opening direction using a motor, which is driving means, by the supply of full power. Therefore, the drawer body 2 starts movement thereof in the door opening direction at the maximum acceleration. At a position at which the door 2*a* is opened slightly from the fully closed position Pc (ten and several mm), a latch riding position Pr is set. Immediately after the latch riding position Pr had been passed, the opening speed of the drawer body 2 is reduced. Thereafter, the drawer body 2 continues the opening motion thereof at a reduced fixed opening speed. From a pulse generator additionally provided on the motor, pulses for reading the rotational speed are always generated.

When the actuator 7 reaches an arrangement position Pso of the full opening detection switch 10 and turns on the full opening detection switch 10, the travel speed of the drawer body 2 is slightly reduced immediately after the turning-on operation of the full opening detection switch 10 has been input to a control unit. The degree of deceleration is set at a ratio such that the drawer body 2 stops completely, when the count number of pulses generated by the pulse generator, after the turning-on operation of the full opening detection switch 10 has been input to a control unit, reaches a predetermined value. The drawer body 2 assumes a fully opened position at a position Po.

Next, the door closing control in the case where the door 2*a* is operated in the door closing direction from the fully opened position Po is explained. The operation in the door closing direction is performed at a fixed closing speed after the initial acceleration period has elapsed. When the actuator 7 reaches a position Psi at which the intermediate switch 5 is arranged and turns on the intermediate switch 5, the turning-on operation is input to the control unit, and the control unit sends a control signal for starting a low-speed operation. The control unit predicts the position of the drawer body 2 at every moment, and causes the drawer body 2 to start actually an low-speed operation at a reduced set closing speed from a position Pre advancing in the predetermined closing direction from the position of the intermediate switch 5.

The drawer body 2 continues the closing operation at the reduced speed, and when the actuator 7 arrives at the latch riding position Pr, information on this arrival is input to the control unit. The control unit sets an increased speed so that the latch hook 11 (refer to FIG. 2 and the like) can get over the latch by increasing momentum. When the engagement of the latch hook 11 with the latch head 9 is finished, the door 2*a* assumes the fully closed position Pc.

If an abnormality is detected when the door is opened or closed, the abnormality detection is informed to the user by using notifying means such as sound or display.

Thus, the switch for giving instruction of deceleration is detected before the door 2*a* is fully opened or fully closed to reduce the speed of the door 2*a*, and further the speed thereof is gradually reduced to a position immediately before the fully opened or closed position and the door 2*a* is stopped gently after the fully opened or closed position has been detected.

What is claimed is:

1. A cooking device having a drawer type automatic door comprising:

a cooking device body formed with a heating chamber therein;

a drawer body which can be drawn out of and accommodated in the heating chamber and integrally has a door capable of closing the opening part of the heating chamber in the accommodated state;

driving means for driving the drawer body in the opening/closing direction and speed control means for controlling the speed of the drawer body using the driving means, wherein when the door is in a fully closed position to close the opening part of the heating chamber, a latch head provided on the drawer body engages with a latch hook attached to the cooking device and turns on a switch which controls an electric supply to a heat resource, with respect to the drawer body, the fully closed position of the door, the before-stop position of the before side of the fully closed position and a latch riding position at which the latch head begins to engage with a latch hook attached to the cooking device body at a position closer to the fully closed position than the before-stop position are settled, the speed control means being configured to reduce the speed of the drawer body in response to the arrival of the drawer body at the before-stop position and increase the closing speed of the drawer body in response to the arrival of the drawer body at the latch riding position, the driving means is provided with counting means for outputting a count according to the displacement of the drawer body, and the displacement of the drawer body is measured by the counting means.

2. The cooking device having a drawer type automatic door according to claim 1, wherein the stop position is a fully opened position of the door, and at the before-stop position, a full opening detection switch detectable by the specific position detecting means is provided.

3. The cooking device having a drawer type automatic door according to claim 2, wherein the stop position is a fully opened position of the door, and at the before-stop position, a full opening detection switch detectable by the specific position detecting means is provided.

4. The cooking device having a drawer type automatic door according to claim 2, wherein the stop position is a fully opened position of the door, and at the before-stop position, a full opening detection switch detectable by the specific position detecting means is provided.

5. The cooking device having a drawer type automatic door according to claim 2, wherein the speed control means increases the closing speed of the drawer body in response to the arrival of the latch head provided on the drawer body at the latch riding position at which the latch head begins to engage with the latch hook attached to the cooking device body at a position closer to the fully closed position than the before-stop position.

6. The cooking device having a drawer type automatic door according to claim 2, wherein the stop position is a fully opened position of the door, and at the before-stop position, a full opening detection switch detectable by the specific position detecting means is provided.

7. The cooking device having a drawer type automatic door according to claim 1, wherein the stop position is a fully closed position of the door, and at the before-stop position, an intermediate switch detectable by the specific position detecting means is provided.

8. The cooking device having a drawer type automatic door according to claim 7, wherein the stop position is a fully closed position of the door, and at the before-stop position, an intermediate switch detectable by the specific position detecting means is provided.

9. The cooking device having a drawer type automatic door according to claim 7, wherein the stop position is a fully closed position of the door, and at the before-stop position, an intermediate switch detectable by the specific position detecting means is provided.

10. The cooking device having a drawer type automatic door according to claim 7, wherein the stop position is a fully closed position of the door, and at the before-stop position, an intermediate switch detectable by the specific position detecting means is provided.

11. The cooking device having a drawer type automatic door according to claim 7, wherein the speed control means increases the closing speed of the drawer body in response to the arrival of the latch head provided on the drawer body at the latch riding position at which the latch head begins to engage with the latch hook attached to the cooking device body at a position closer to the fully closed position than the before-stop position.

12. The cooking device having a drawer type automatic door according to claim 1, wherein the speed control means can arbitrarily change the opening/closing speed of the door.

13. The cooking device having a drawer type automatic door according to claim 1, wherein if an abnormality is detected when the door is opened or closed, the abnormality detection is informed to the user by using notifying means such as sound or display.

14. The cooking device having a drawer type automatic door according to claim 1, wherein the speed control means increases the closing speed of the drawer body in response to the arrival of the latch head provided on the drawer body at the latch riding position at which the latch head begins to engage with the latch hook attached to the cooking device body at a position closer to the fully closed position than the before-stop position.

15. The cooking device having a drawer type automatic door according to claim 1, wherein further comprising specific position detecting means for detecting that the drawer body passes through the before-stop position, the driving means is provided with counting means for outputting a count according to the displacement of the drawer body, the arrival of the drawer body at the latch, riding position is determined based on the displacement of the drawer body measured by the counting means after passing through the before-stop position.

* * * * *